US006115842A

United States Patent [19]

Hochmuth

[11] Patent Number: 6,115,842

[45] Date of Patent: Sep. 12, 2000

[54] GOALKEEPER'S GLOVE

[76] Inventor: Peter Hochmuth, Weissenburger Strasse 19, D-91757 Treuchtlingen, Germany

[21] Appl. No.: 09/387,911

[22] Filed: Sep. 1, 1999

[30] Foreign Application Priority Data

Jan. 11, 1999 [DE] Germany ..... 299 00 293

[51] Int. Cl.[7] ..... A41D 19/00

[52] U.S. Cl. ..... 2/161.1; 2/16; 2/164

[58] Field of Search ..... 2/16, 20, 159, 2/161.1, 161.2, 161.3, 161.6, 163, 164, 167, 169

[56] References Cited

U.S. PATENT DOCUMENTS 5,937,444 8/1999 Hochmuth ..... 2/161.1

FOREIGN PATENT DOCUMENTS 2035717 8/1992 Canada ..... 2/16

3135-756 4/1983 Germany ..... 2/161.1

2237974 5/1991 United Kingdom ..... 2/16

*Primary Examiner*—John J. Calvert

*Assistant Examiner*—Katherine Moran

*Attorney, Agent, or Firm*—Brown & Wood, LLP

[57] ABSTRACT

A goalkeeper's glove including a thumb section having a latex layer for covering an outer side of an inner hand portion of the thumb section and overlapping the gusset-side elongate region of the thumb section and passing into a latex accessory layer covering upper hand portion of the thumb section, and a leather piece for covering the upper hand portion of the thumb section with and connected with the latex accessory along a free edge of the latex accessory layer with a first seam, and connected with the inner hand portion of the thumb section along the ball-side elongate region of the thumb section with a second seam, and with the leather piece flatwise abutting the latex accessory layer along its stitched free edge and in the tip region.

5 Claims, 1 Drawing Sheet

GOALKEEPER'S GLOVE

BACKGROUND OF THE INVENTION

1. Field of the Invention

The present invention relates to a goalkeeper's glove including a thumb section having a ball-side elongate region, a gusset-side elongate region, and a tip region connecting the ball-side and gusset-side elongate regions with each other, a latex layer for covering an outer side of an inner hand portion of the thumb section, with the latex layer overlapping the gusset-side elongate region of the thumb section and passing into a latex accessory layer covering upper hand portion of the thumb section, and a leather piece for covering the upper hand portion of the thumb section and connected with the latex accessory layer along a free edge of the latex accessory layer with a first seam, and connected with the inner hand portion of the thumb section along the ball-side elongate region with a second seam.

2. Description of the Prior Art

In the known goalkeeper's gloves of the type described above, the thumb upper hand side leather piece and the latex accessory layer, which covers the upper hand side thumb portion, are lined from beneath along the stitched free edge of the latex accessory layer and also in the tip region, with edge strips. Thus, the stitching seam is covered. This form of a thumb section makes it aesthetically unappealing and makes the producing of the thumb section rather expensive. Furthermore, the edge strips, which lineup the thumb leather strip and the latex accessory layer, makes the glove user feel uncomfortable when the user inserts the thumb into the thumb section of the glove.

Accordingly, an object of the present invention is to provide a goalkeeper's glove of the above-described type in which the edge strip, which covers the seam that connects the leather piece with the latex accessory layer from beneath, is eliminated.

SUMMARY OF THE INVENTION

This and other objects of the present invention, which will become apparent hereinafter, are achieved by providing a glove in which the leather piece flatwise abuts the latex accessory layer along the stitched free edge of the latex accessory layer and in the tip region.

In the goalkeeper's glove according to the present invention, the edge strips overlap each other upon stitching of the leather piece with the latex accessory layer. This is acceptable for a glove user, facilitates the production of thumb sections, and makes the thumb section aesthetically appealing. The seam, which is associated with the free edge of the latex accessory layer is visible from outside.

It is particularly preferable and advantageous when the latex accessory layer has a region protruding from a straight line connecting a point in the tip region of the latex accessory layer with a point in the gusset-side elongate region of the latex accessory layer, with the free edge of the latex accessory layer having in the protruding region, a free edge section extending along a curved line.

The free edge, thus, does not extend as two inclined toward each other, edge portions but rather is formed as an arcuate section. The arcuate shape of the edge looks more aesthetically appealing. Such shape cannot be produced, with the edge strips lining the leather piece and the latex accessory layer from beneath, or can be produced only with much difficulties.

It is further particularly preferable and advantageous when the latex layer extends outwardly from the overlap of the gusset-side elongate region toward the ball-side elongate region and past center line of a width of the upper hand portions of the thumb section.

This improves the external appearance of the thumb section and functioning of the latex accessory layer. If the upper hand side portion of the thumb section is associated with a center line, the free edge of the latex accessory layer, which extends between a point in the tip region and a point in the gusset-side elongate region, lies, over a larger portion of its length, on the outer side of the center line.

Still further, it is preferable and advantageous when the leather piece is stitched to an intermediate strip arranged between upper and inner portions of the glove. This facilitates producing of the thumb sections the latex layer of which, provided on the inner hand thumb portion, as a rule, is formed as one piece with the entire latex layer covering the inner hand portion of the glove.

It is also preferable and advantageous when the latex layer and the latex accessory layer is formed as a one-piece member, and the latex layer defines an index finger edge which passes, in a transition region, into the free edge of the latex accessory layer. The transition region defines a recess which is slightly inclined with respect to the outer index finger edge and has a length constituting a small fraction of a length of the finger outer edge, and a short width in a direction perpendicular to longitudinal extent of the index finger edge.

This facilitates cutting of the entire latex layer which forms the inner hand portion, the inner hand thumb portion and the latex accessory layer.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
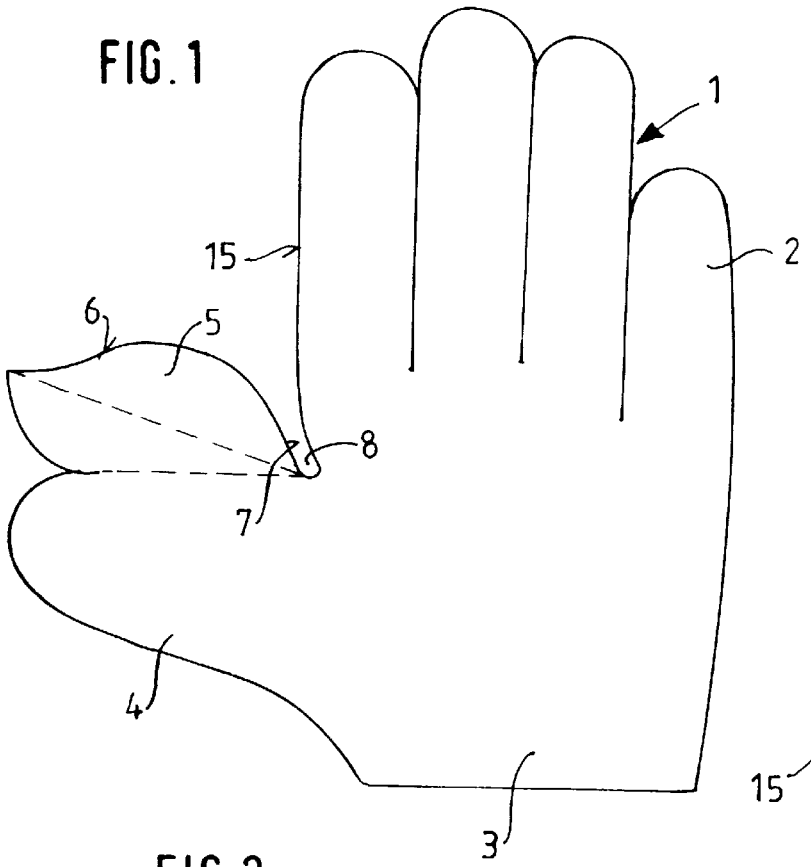
FIG. 1 shows a plan view of an entire latex layer of a goalkeeper's glove with a latex accessory layer according to the present invention.

FIG. 1 shows an inner hand latex layer 1 of a goalkeeper's glove and having four finger region 2 and a palm region 3 which passes into the thumb region 4. In the thumb region 4, the inner hand latex layer 1 passes into a latex accessory layer 5. The latex accessory layer 5 has a free edge 6 which passes into a rectilinear index finger edge 15 in the transition region 7. The transition region 7 defines a U-shaped recess 8 the center line of which forms with the extension of the index finger edge 15 an angle smaller or equal to 450 and a length of which, in the direction of the U-leg and the width, measured transverse to the U-leg, are small.

Figure 2:
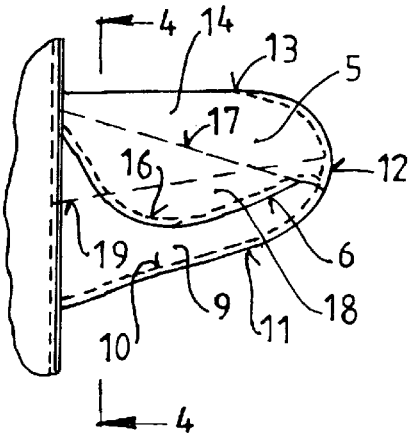
FIG. 2 shows a plan view of an upper hand thumb portion of a thumb section of a goalkeeper's glove according to the present invention.
Figure 3:
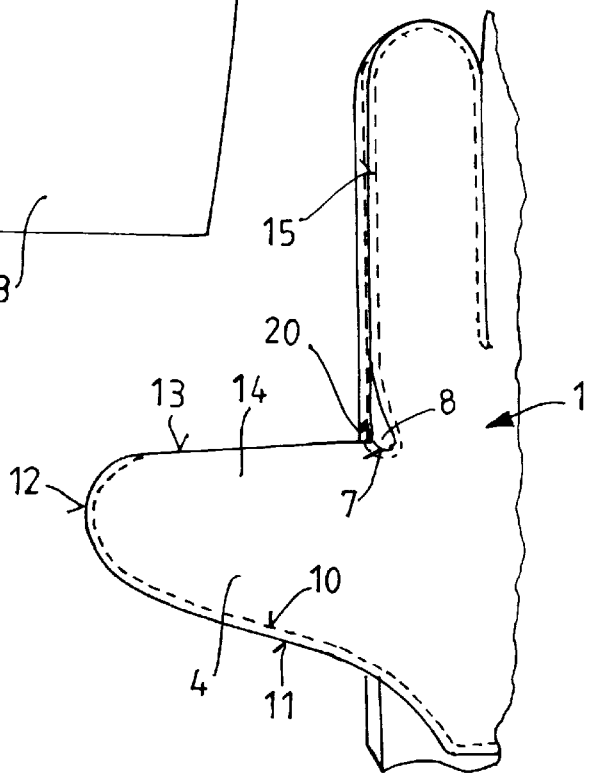
FIG. 3 shows a plan view of an inner hand thumb portion of a thumb section of a goalkeeper's glove according to the present invention.

As shown in FIGS. 2–3, the inner hand side thumb portion 4 of the latex layer 1 is connected with a leather piece of the upper hand side thumb portion with a seam 10 forming a ball-side elongate region 11 which passes into a tip region 12. The latex accessory layer 5 forms, in a gusset side elongate region 13, an overlap 14. The seam 10, which extends up to the tip region 12, holds there also the latex accessory layer 5. The latex accessory layer 5 is connected along its free edge with the thumb section 9 of the glove by a seam 16. The free edge 6 of the latex accessory layer 5 forms a curved region 16 and extends up to the tip region 12. The latex accessory layer 5 forms, with respect to a straight line 17, which is shown with a dash line, a protruding region 18. The center of the width of the thumb, on the upper hand side of the thumb section of the glove, is shown in FIG. 2 with a center line 19 shown with a dash line.

Figure 4:
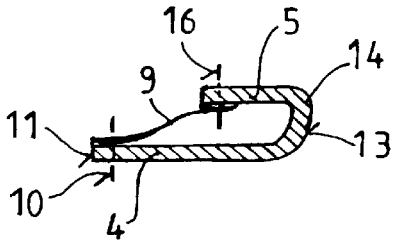
FIG. 4 shows a cross-sectional view along line 4—4 in FIG. 2.

According to FIG. 4, which shows a cross-sectional view along the width of the thumb section, the leather piece 9 flatwise abuts the thumb region 4 of the inner hand latex layer 1, with the thumb region 4 being secured to the leather piece 9 by the seam 10. A portion of the leather piece 0 also abuts the latex accessory layer 5 which is secured to the leather piece 9 by the seam 16. The latex layer 1 is supported on a layer of a foam material (not shown) which, in turn, is placed on a cloth support sheet. Intermediate strips 20 can be seen in FIG. 3, which, in per se known manner, is provided on a side of the index finger edge 15 and inner hand outer hand portions of a goalkeeper's glove. The intermediate strip 20 is stitched to the leather piece 9.

Though the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A goalkeeper's glove, comprising:

a thumb section having a ball-side elongate region, a gusset-side elongate region, and a tip region connecting the ball-side and gusset-side elongate regions with each other;

a latex layer for covering an outer side of an inner hand portion of the thumb section, the latex layer overlapping the gusset-side elongate region of the thumb section and passing into a latex accessory layer covering upper hand portion of the thumb section; and a leather piece for covering the upper hand portion of the thumb section, wherein the leather piece is connected with the latex accessory layer along a free edge of the latex accessory layer with a first seam, and is connected with the inner hand portion of the thumb section along the ball-side elongate region with a second seam, and wherein the leather piece flatwise abuts the latex accessory layer along the stitched free edge of the latex accessory layer and in the tip region.

2. A goalkeeper's glove as set forth in claim 1, wherein the latex accessory layer has a region protruding from a straight line connecting a point in the tip region of the latex accessory layer with a point in the gusset-side elongate region of the latex accessory layer, the free edge of the latex accessory layer having, in the protruding region, a free edge section extending along a curved line.

3. A goalkeeper's glove as set forth in claim 1, wherein the latex accessory layer extends outwardly from the overlap of the gusset-side elongate region toward the ball side elongate region and past a center line of a width of the upper hand portion of the thumb section.

4. A goalkeeper's glove as set forth in claim 1, further comprising an intermediate strip arranged between upper hand and inner hand portions of the glove, the leather piece being stitched to the intermediate strip.

5. A goalkeeper's glove as set forth in claim 1, wherein the latex layer and the latex accessory layer is formed as a one-piece member, and wherein the latex layer defines an index finger edge which passes, in a transition region, into the free edge of the latex accessory layer, the transition region limiting a recess which is slightly inclined with respect to the outer index finger edge, which has a length constituting a small fraction of a length of the finger outer edge, and a short width in a direction perpendicular to a longitudinal extend of the index finger edge.

* * * * *